US006938840B1

(12) United States Patent
Trutschel et al.

(10) Patent No.: US 6,938,840 B1
(45) Date of Patent: Sep. 6, 2005

(54) FUEL INJECTION VALVE

(75) Inventors: Ralf Trutschel, Wolfen (DE); Frank Dallmann, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,857

(22) PCT Filed: Aug. 25, 1999

(86) PCT No.: PCT/DE99/02658

§ 371 (c)(1),
(2), (4) Date: May 31, 2001

(87) PCT Pub. No.: WO00/12892

PCT Pub. Date: Mar. 9, 2000

(30) Foreign Application Priority Data

Aug. 27, 1998 (DE) ..... 198 38 949
Feb. 24, 1999 (DE) ..... 199 07 860

(51) Int. Cl.[7] ..... F02M 61/00
(52) U.S. Cl. ..... 239/533.12; 239/585.5; 239/463
(58) Field of Search ..... 239/533.2–533.12, 239/585.1–585.5, 463

(56) References Cited

U.S. PATENT DOCUMENTS 4,650,121 A 3/1987 Augustin
4,890,794 A * 1/1990 Imafuku et al. ..... 239/533.12
4,971,254 A 11/1990 Wieczorek et al.
5,350,119 A 9/1994 Bergstrom
5,772,124 A * 6/1998 Tamaki et al. ..... 239/533.12
5,878,962 A * 3/1999 Shen et al. ..... 239/463
5,996,912 A * 12/1999 Ren et al. ..... 239/585.5

FOREIGN PATENT DOCUMENTS

| | | |
|---|---|---|
| DE | 30 46 889 | 7/1982 |
| DE | 38 08 635 | 9/1989 |
| JP | 10 047 210 | 2/1998 |
| WO | WO 99 32 784 | 7/1999 |

* cited by examiner

*Primary Examiner*—Christopher Kim
(74) *Attorney, Agent, or Firm*—Kenyon & Kenyon

(57) ABSTRACT

A fuel injector, in particular a high pressure injector for direct injection of fuel into a combustion chamber of an internal combustion engine having externally supplied ignition and mixture compression, is characterized in that a valve needle, which is movable axially along a longitudinal axis of the valve, has a specially designed valve closing section on its downstream end. To open and close the valve, the valve closing section works together with a fixed valve seat. Swirl-producing elements are arranged upstream from the valve seat while a flattened face running perpendicular to the longitudinal axis of the valve is provided on the downstream end of the valve closing section downstream from the valve seat.

12 Claims, 5 Drawing Sheets

FUEL INJECTION VALVE

FIELD OF THE INVENTION

The present invention relates to a fuel injector according to present invention.

BACKGROUND INFORMATION

An electromagnetic ally operated fuel injector is described in German Published Patent Application No. 38 08 635, which describes a valve closing section designed on an axially movable valve needle to work together with a fixed valve seat for opening and closing the valve. The valve closing section is designed with a conical shape narrowing in the downstream direction, while the valve seat has the form of a truncated cone. This valve closing section forms the downstream end of the valve needle which tapers to a conical tip. Upstream from the valve closing section and the valve seat, the valve needle is provided with a plurality of spiral-shaped fuel channels through which fuel to be injected reaches the valve seat with a swirl to improve fuel atomization and control the fuel flow rate.

In addition to the conically tapered downstream tip of the valve needle, U.S. Pat. No. 5,350,119 describes a fuel injector having an axially movable valve needle with a rounded valve closing section forming the downstream end of the valve needle.

In addition, German Patent No. 30,46 889 describes a fuel injector having a flat armature and a valve closing part attached thereto. This movable valve member works together with a valve seat rigidly connected to the housing. The closing part has a convex valve closing section sealed by a flat polished section running perpendicular to the longitudinal axis of the valve. Downstream from the valve seat is a collecting space whose volume should be as small as possible and which is delimited by the valve seat body, the flat lower end of the valve closing section and the opposite planar upper bordering face of a swirl body arranged downstream from the valve seat body. Each swirl body has a plurality of swirl channels beginning at the side of the swirl body and opening into a central swirl chamber.

Japanese Laid Open Patent Application No. 10047210 describes a fuel injector for a fuel injection system of an internal combustion engine, where the fuel injector has an energizable actuating element and a valve needle that is movable axially along a longitudinal axis of the valve and has on its downstream end a valve closing section which works together with a fixed valve seat to open and close the valve. The valve seat is designed on a flat valve seat element. Upstream from the valve seat, the valve has a swirl body which functions as a guide for the valve needle and also produces a swirl in the fuel spray. Downstream from the valve seat, a flattened face running perpendicular to the longitudinal axis of the valve is provided on the downstream end of the valve closing section. The valve seat is followed by an outlet orifice having a diameter D which is much greater than the diameter of the flattened face formed on the valve needle.

SUMMARY OF THE INVENTION

The fuel injector according to the present invention has the advantage that improved fuel preparation is achieved upstream from the valve seat in comparison with known valves in that a swirl is produced in the fuel. In particular, the improved quality of fuel preparation concerns the prestream.

This prestream is formed by fuel which collects in an inner swirl chamber of the swirl-producing elements in front of the valve seat when the valve is closed. When the valve opens, most of this fuel flows largely axially and without a swirl toward an outlet orifice arranged downstream from the valve seat. The measures according to the present invention effectively allow better preparation of fuel in the prestream by making use of the fact that the starting flow which forms the prestream and the development of a wall film in the outlet orifice can be influenced to a great extent by the design of the valve needle tip which contributes to forming the flow region of the spiral flow. Droplet size can be reduced by the method according to the present invention, thus producing a finer fuel spray. The energy loss by the fuel on the flattened surface of the valve needle reduces the extent of the prestream, which tends to be harmful. In comparison with valve needles having a tapered point or a rounded end, a shortened prestream having lower penetration is advantageously achieved.

In addition, increased homogeneity of the subsequent swirling main stream can be achieved in comparison with valve needles having a tapered point or a rounded end.

It is especially advantageous if, given a known size of the outlet orifice having diameter D, diameter d of the flattened area formed on the downstream end of the valve needle is selected so that ratio d/D amounts to approx. 1.5.

The swirl-producing elements are advantageously designed as disk-shaped swirl elements having a very simple structure which is thus easily molded. In comparison with swirl bodies having grooves or similar swirl-producing recesses on an end face, an inner opening area can be created with the simplest expedient in the swirl element, extending over the entire axial thickness of the swirl element and surrounded by an outer peripheral edge area.

Like the swirl element and the valve seat element, the guide element can also be easily manufactured. It is especially advantageous that the guide element having an inner guide orifice functions as a guide for the valve needle traversing it. In one design of the guide element having alternating projecting areas in the form of teeth with recesses between them on the outer periphery, it is possible to guarantee optimum flow into the swirl channels of the swirl element underneath in a simple way.

DETAILED DESCRIPTION

Figure 1:
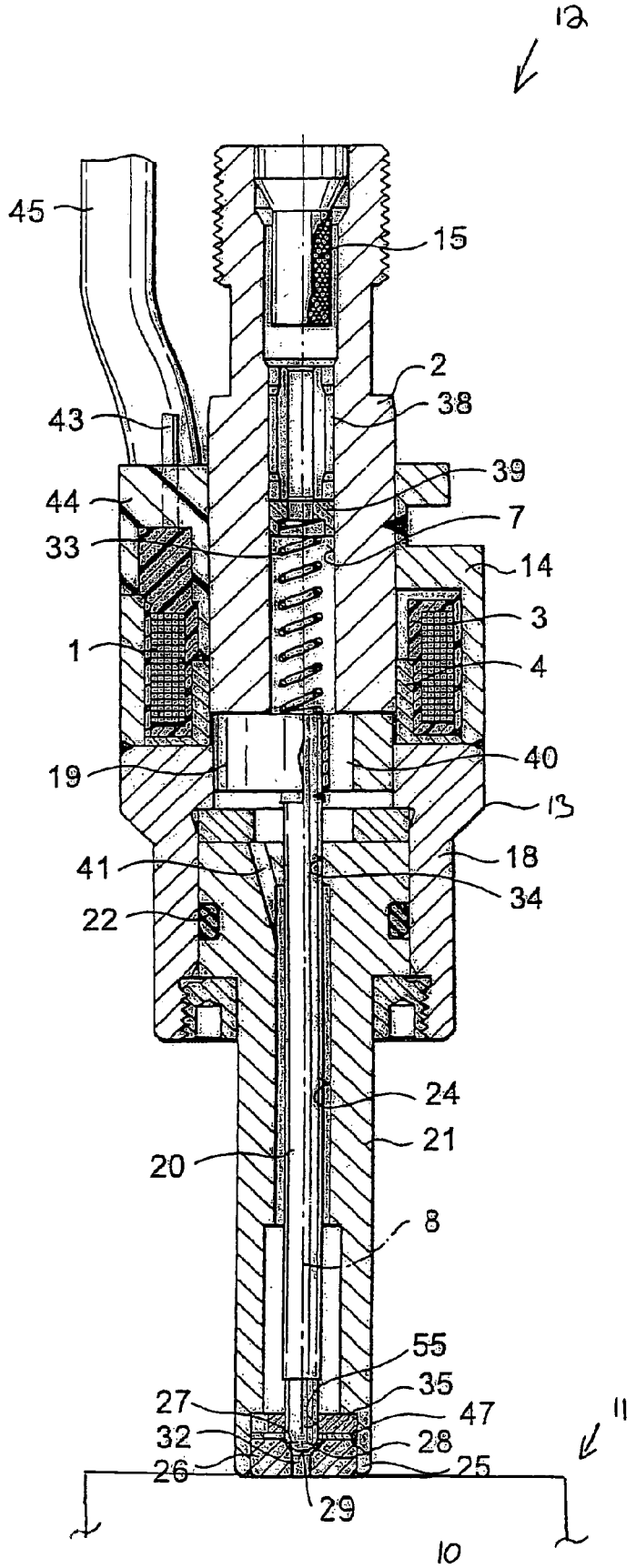
FIG. 1 shows a first embodiment of a fuel injector.

The electromagnetically operated valve shown in FIG. 1 as an example of an embodiment in the form of an injection valve 13 for the fuel injection system 12 of an internal combustion engine with externally supplied ignition has a tubular, largely hollow cylindrical core 2 which is at least partially surrounded by a solenoid coil 1 and functions as an internal pole of a magnetic circuit. The fuel injector that is illustrated in FIG. 1 is especially suitable as a high-pressure injection valve for direct injection of fuel into the combustion chamber 10 of an internal combustion engine 11 and is configured for a direct injection of a fuel into a combustion chamber 10 of and internal combustion engine 11. A stepped coil body 3 made of plastic, for example, holds a winding of solenoid coil 1 and permits an especially short and compact design of the injection valve in the area of solenoid coil 1 in combination with core 2 and a toroidal, nonmagnetic intermediate part 4 having an L-shaped cross section partially surrounded by solenoid coil 1.

A longitudinal through orifice 7 is provided in core 2, extending along a longitudinal axis 8 of the valve. Core 2 of the magnetic circuit also functions as a fuel inlet connection, longitudinal orifice 7 forming a fuel feed channel. An outer metallic (e.g., ferritic) housing part 14 fixedly connected to core 2 above solenoid coil 1 closes the magnetic circuit as an external pole or an external conducting element and completely surrounds solenoid coil 1 at least in the peripheral direction. A fuel filter 15 is provided in longitudinal orifice 7 of core 2 at the inlet end to filter out fuel components whose size might cause blockage or damage in the injector. Fuel filter 15 is secured in core 2 by pressing, for example.

Core 2 together with housing part 14 forms the inlet end of the fuel injector, upper housing part 14 extending axially downstream, for example, beyond solenoid coil 1. Upper housing part 14 is connected tightly and rigidly to a lower tubular housing part 18 which surrounds and accommodates an axially movable valve part composed of an armature 19 and a rod-shaped valve needle 20, i.e., an elongated valve seat carrier 21. Two housing parts 14 and 18 are rigidly connected by a peripheral weld, for example.

In the embodiment illustrated in FIG. 1, lower housing part 18 and valve seat carrier 21, which is largely tubular, are joined fixedly together by screwing; however, welding, soldering or crimping are other possible joining methods. A seal is produced between housing part 18 and valve seat carrier 21 by a sealing ring 22, for example. Over its entire axial extent, valve seat carrier 21 has a continuous inner orifice 24 which is concentric with longitudinal axis 8 of the valve.

At its lower end 25, which also forms the downstream closure of the entire fuel injector, valve seat carrier 21 surrounds a disk-shaped valve seat element 26 which fits into through hole 24 with a valve seat face 27 tapering in the form of a truncated cone downstream. Rod-shaped valve needle 20 having a mostly circular cross section is arranged in through hole 24 and has a valve closing section 28 on its downstream end. This valve closing section 28, which is spherical or partially spherical or rounded or has a conical taper, works together with valve seat face 27 provided in valve seat element 26 in a known manner. Valve closing section 28 as the downstream end of valve needle 20 ends downstream with a flattened face 29 which is designed to be flat according to the present invention and runs perpendicular to longitudinal axis 8 of the valve. Flattened face 29 is, for example, a flat polished section. Downstream from valve seat face 27, at least one outlet orifice 32 for the fuel is provided in valve seat element 26.

The injector is operated electromagnetically in a known way. However, a piezoactuator or a magnetostrictive actuator is also conceivable as an energizable actuating element. Likewise, actuation by a controlled pressure-loaded piston is also conceivable. The electromagnetic circuit having solenoid coil 1, core 2, housing parts 14 and 18 and armature 19 is responsible for the axial movement of valve needle 20 and thus for opening the injector against the spring force of a restoring spring 33 arranged in longitudinal orifice 7 of core 2 and for closing the injector. Armature 19 is connected by a weld, for example, to the end of valve needle 20 facing away from valve closing section 28 and is aligned with core 2. A guide opening 34 in valve seat carrier 21 on the end facing armature 19 and also a disk-shaped guide element 35 having an accurately dimensioned guide opening 55 arranged upstream from valve seat element 26 are provided for guiding valve needle 20 during its axial movement with armature 19 along longitudinal axis 8 of the valve. Armature 19 is surrounded by intermediate part 4 during its axial movement.

Another disk-shaped element, namely a swirl element 47, is arranged between guide element 35 and valve seat element 26, so that all three elements 35, 47 and 26 sit directly one on the other and are accommodated in valve seat carrier 21. Three disk-shaped elements 35, 47 and 26 are fixedly joined together by material bonding, for example.

An adjusting sleeve 38 which is inserted, pressed or screwed into longitudinal orifice 7 of core 2 is used to adjust the spring prestress of restoring spring 33, which is in contact with adjusting sleeve 38 over a centering piece 39 on its upstream end and is supported on armature 19 on its opposite end. Armature 19 has one or more bore-like flow channels 40 through which fuel can flow into through hole 24 from longitudinal orifice 7 in core 2 by passing through connecting channels 41 downstream of flow channels 40 near guide opening 34 in valve seat carrier 21.

The lift of valve needle 20 is predetermined by the installed position of valve seat element 26. When solenoid coil 1 is not energized, one end position of valve needle 20 is defined by valve closing section 28 coming in contact with valve seat face 27 of valve seat element 26, while the other end position of valve needle 20 when solenoid coil 1 is energized is determined by armature 19 coming in contact with the downstream end face of core 2. The surfaces of the parts in the latter stop area may be chrome plated, for example.

Electric contacting of solenoid coil 1 and thus its energization are accomplished over contact elements 43 which are provided with a plastic sheathing 44 outside of coil body 3. Plastic sheathing 44 may extend over additional parts (e.g., housing parts 14 and 18) of the fuel injector. An electric cable 45 supplying electric power to solenoid coil 1 extends out of plastic sheathing 44. Plastic sheathing 44 projects through upper housing part 14, which is interrupted in this area.

Figure 2:
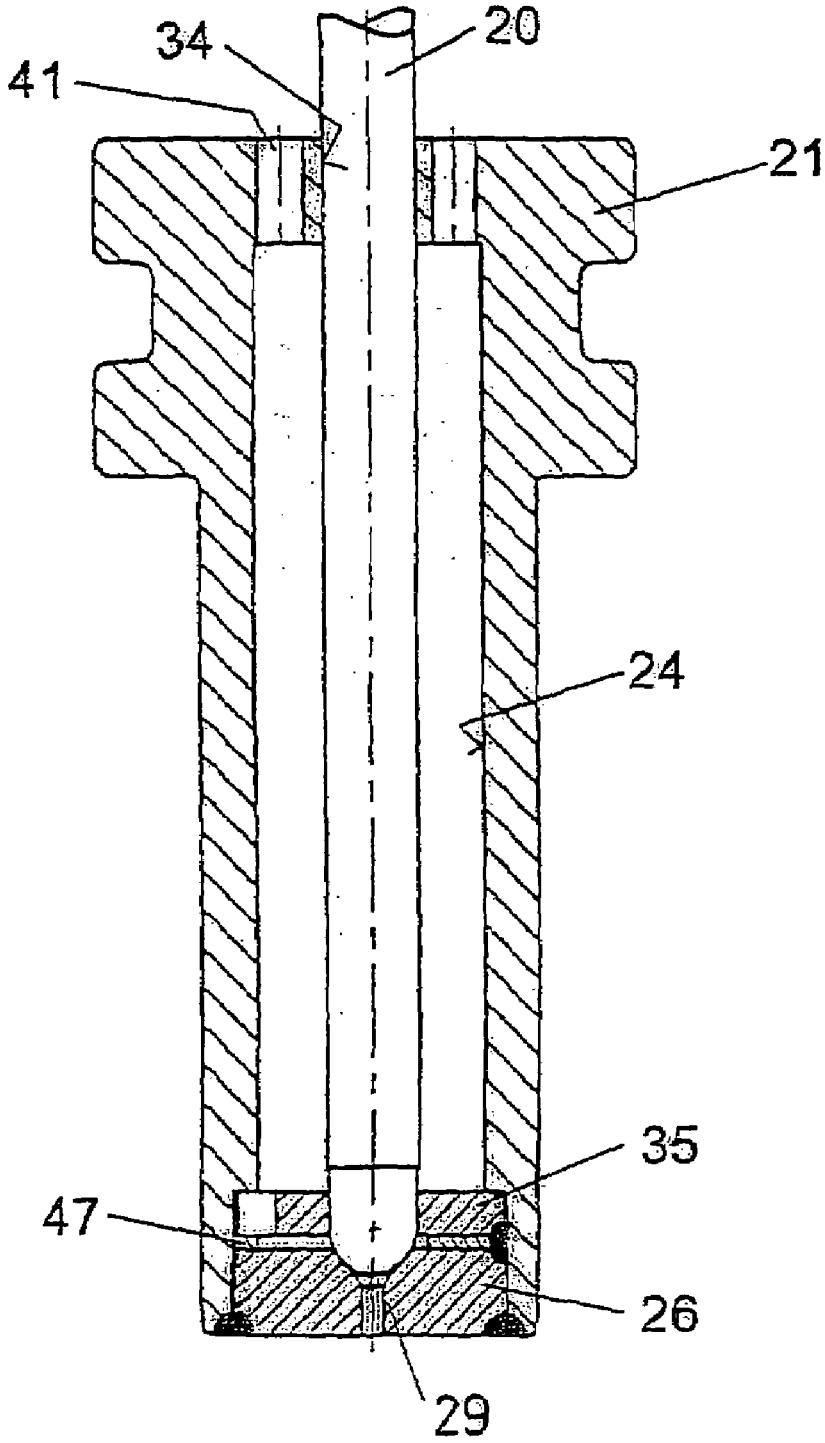
FIG. 2 shows a second example of a fuel injector, showing only the downstream valve end.

FIG. 2 shows a second embodiment of a fuel injector, showing only the downstream end of the valve. In contrast with the example shown in FIG. 1, several connecting channels 41 running in parallel to the valve axis are provided in valve seat carrier 21 in the area of guide opening 34. To permit reliable influx into valve seat carrier 21, through hole 24 is designed to have a larger diameter, while valve seat carrier 21 is designed to have a thinner wall.

Figure 3:
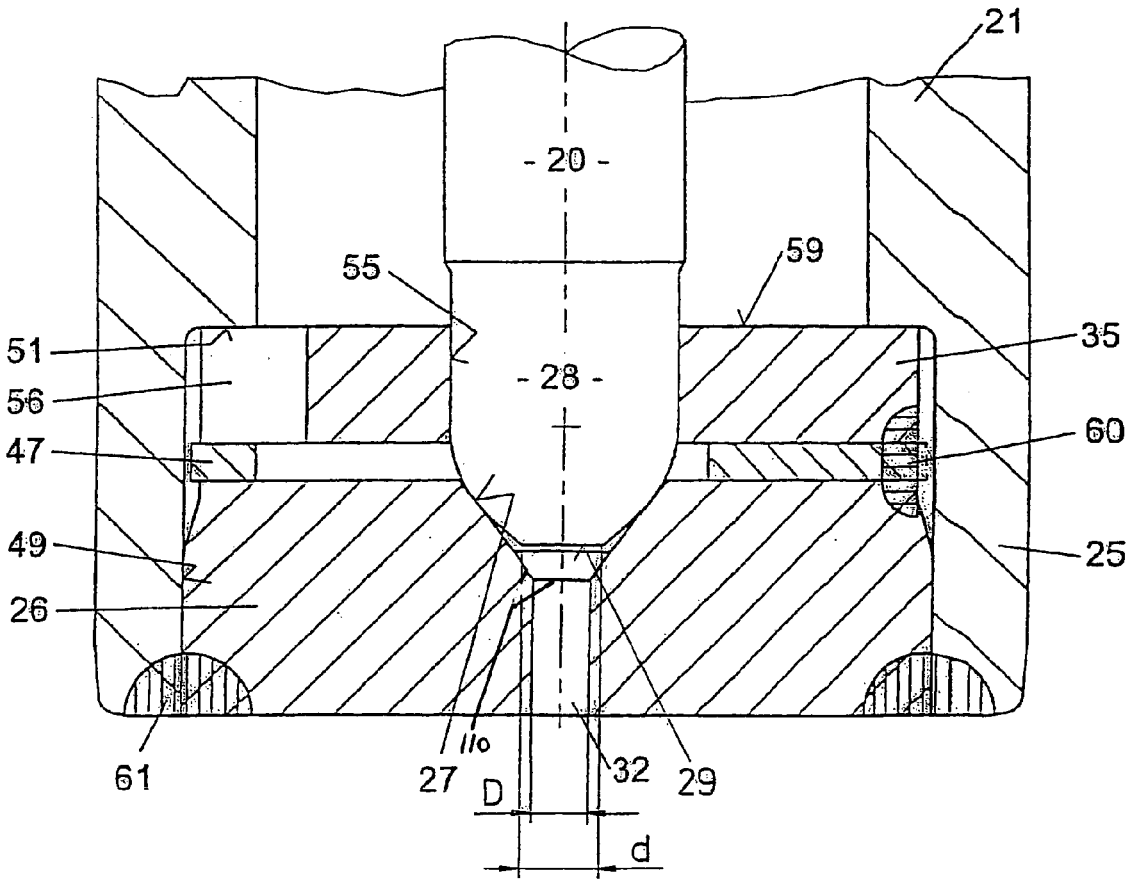
FIG. 3 shows a first guide area and seat area as an enlarged detail from FIG. 2.

FIG. 3 shows the guide area and seat area as a detail from FIG. 2 on an enlarged scale to better illustrate this valve area, where the end of the valve needle is designed according to the present invention. The guide area and seat area provided in spray end 25 of valve seat carrier 21 in its through hole 24 is formed in the embodiment illustrated in FIG. 3 by three axially successive disk-shaped elements having separate functions that are fixedly linked together.

Guide element 35, very flat swirl element 47 and valve seat element 26 are provided one after the other in the downstream direction.

Valve seat element 26 may have an outside diameter such that it can fit tightly with a small clearance in a lower section 49 of through hole 24 in valve seat carrier 21 downstream from a step 51 provided in through hole 24. Guide element 35 and swirl element 47 have a slightly smaller outside diameters than valve seat element 26, for example.

Guide element 35 has a dimensionally accurate inside guide orifice 55 through which valve needle 20 moves during its axial movement. Guide element 35 has several recesses 56 distributed over its outer circumference, guaranteeing fuel flow along the outer circumference of guide element 35 into swirl element 47 and further in the direction of valve seat face 27. An embodiment of swirl element 47 and an embodiment of guide element 35 are described in greater detail with reference to FIGS. 7 and 8.

The three elements 35, 47 and 26 are in direct contact at their respective end faces and are fixedly joined together before being assembled in valve seat carrier 21. The fixed connection of individual disk-shaped elements 35, 47 and 26 is accomplished through material bonding or welding as preferred joining methods on the outer circumference of elements 35, 47, 26. In the example shown in FIG. 3, weld spots or short welds 60 are provided in the circumferential areas where guide element 35 has no recesses 56. After three elements 35, 47, 36 are joined, guide opening 55, valve seat face 27 and top end face 59 of guide element 35 are ground in a clamp. Thus, these three faces have a very low radial eccentricity relative to one another.

The entire multi-disk valve body is inserted into through hole 24 until top end face 59 of guide element 35 is in contact with step 51. The valve body is secured by a weld 61 produced by a laser, for example, on the lower end of the valve between valve seat element 26 and valve seat carrier 21.

According to the present invention, the downstream end of valve closing section 28 and thus also of the entire valve needle 20 are provided with flattened face 29 running perpendicular to longitudinal axis 8 of the valve. Flattened face 29 provided on valve needle 20 has a diameter d which is greater than diameter D of outlet orifice 32 downstream, so that d>D. It is especially advantageous if diameter d is selected when the size of outlet orifice 32 is known so that ratio d/D is approx. 1.5. When swirl is produced upstream of valve seat face 27, two successive types of stream are formed when the valve is opened by the lifting of valve closing section 28 from valve seat face 27. When the valve opens, first a prestream enters outlet orifice 32. This prestream is formed by fuel that has collected in an inner swirl chamber 92 of swirl element 47 upstream from the valve seat when the valve is closed. When the valve opens, this fuel flows mostly axially and without a swirl toward outlet orifice 32. Only directly after this follows the actual main stream formed by fuel which has flowed through swirl element 47 immediately prior to that and therefore has a swirl.

Flattened face 29 on valve needle 20 then causes improved preparation of the prestream in an advantageous manner, because flattened face 29 permits a preliminary turbulence in the fuel. Droplet size can be reduced in this way, resulting in a finer fuel spray. In addition, greater homogeneity of the main stream in comparison with valves having a tapered or rounded end can be achieved in this way. It should be pointed out explicitly that the design of swirl element 47 arranged upstream from valve seat 27 is irrelevant for the present invention. Instead of disk-shaped swirl element 47 shown here, swirl-producing elements of any desired design (e.g., cylindrical swirl bodies, swirl grooves on the valve needle) may also be used.

In the other embodiments in the following figures, parts that are the same or have a similar effect to those in the embodiment in FIGS. 2 and 3 are indicated with the same reference numbers. The main differences include the design of outlet orifice 32 in valve seat element 26 and the mounting of valve seat element 26 on valve seat carrier 21, but not the design of the end of the valve needle according to the present invention.

As illustrated in FIG. 3, a projection of the flattened face 29 in a direction perpendicular to entry plane 110 completely covers entry plane 110.

Figure 4:
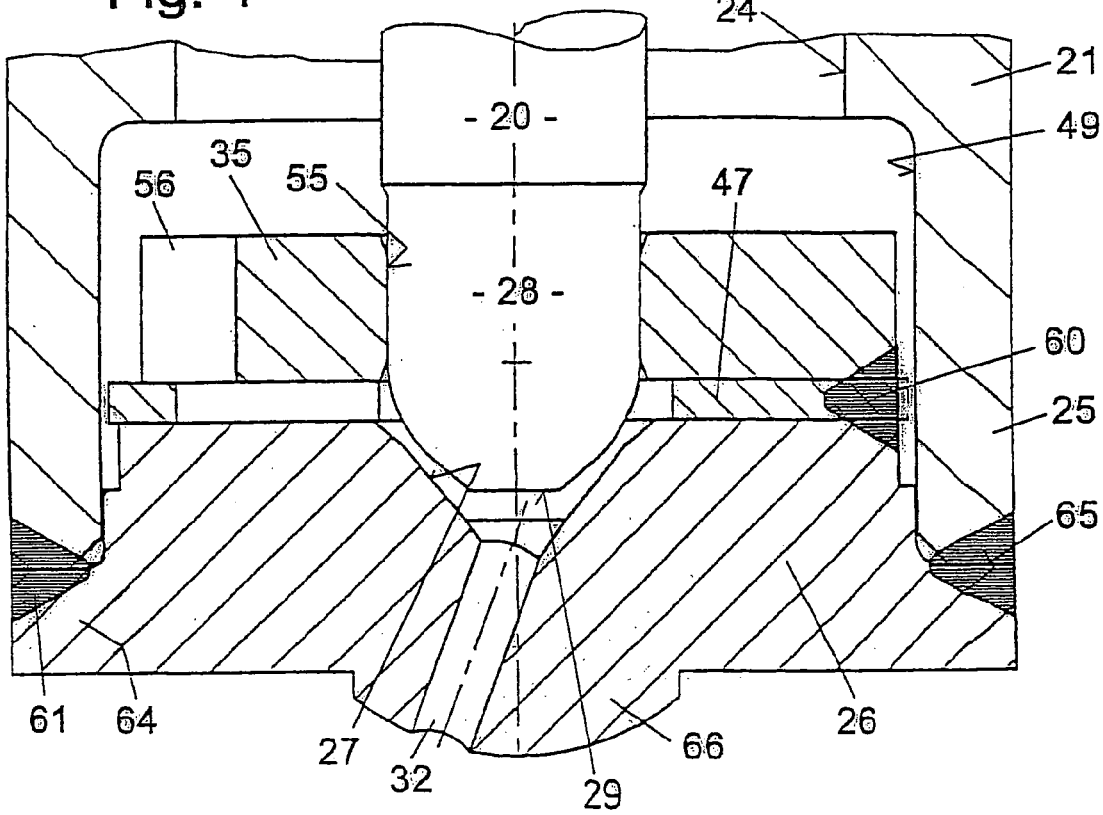
FIG. 4 shows a second guide area and seat area.

In the example shown in FIG. 4, valve seat element 26 has a peripheral flange 64 which grips under the downstream end of valve seat carrier 21. Top side 65 of peripheral flange 64 is ground with guide opening 55 and valve seat face 27 in a clamp. The three-disk valve body is inserted until coming in contact with top side 65 of flange 64 at end 25 of valve seat carrier 21. Both parts 21 and 26 are welded together in this contact area. Outlet orifice 32 is introduced at an inclination to longitudinal axis 8 of the valve, ending downstream in a convex spray area 66.

Figure 5:
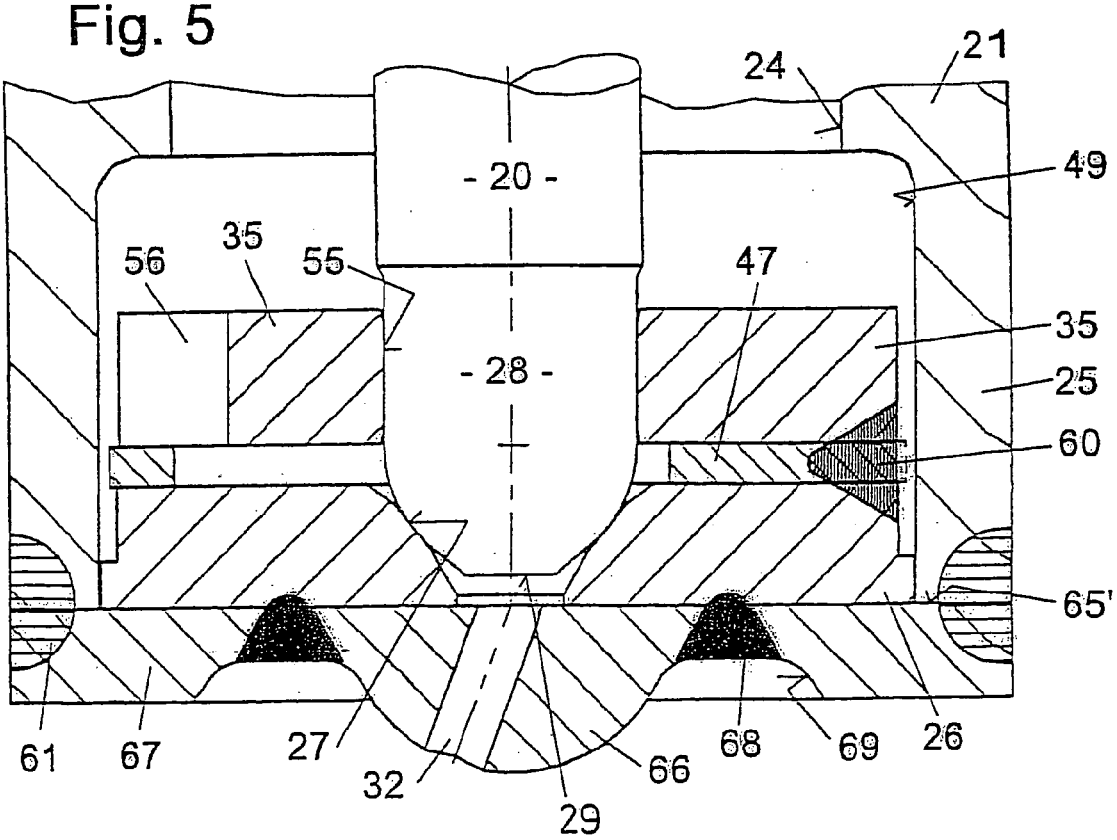
FIG. 5 shows a third guide area and seat area.

The example shown in FIG. 5 corresponds essentially to the example in FIG. 4, the main difference being that an additional fourth disk-shaped spray element 67 is provided here in the form of a spray hole disk having outlet orifice 32. Thus in comparison with FIG. 4, valve seat element 26 is divided again downstream from valve seat face 27. Spray element 67 and valve seat element 26 are fixedly joined by a weld 68 produced by laser welding, for example, with the welding performed in an annular peripheral recess 69. In addition to laser welding, bonding and resistance welding are suitable joining methods for this joint. In the area of top side 65' of spray element 67 and end 25 of valve seat carrier 21, the two parts are joined fixedly (weld 61).

To prevent wear, valve seat element 26 has a high carbon content and is highly tempered, making it less weldable. Spray element 67, however, is made of a more weldable material. Furthermore, weld 68 need have only a low load bearing capacity. Outlet orifice 32 can be produced inexpensively late in the manufacturing process by drilling, for example. At the entrance to outlet orifice 32 there is a sharp hole edge which produces turbulence in the flow, resulting in atomization in very fine droplets.

Figure 6:
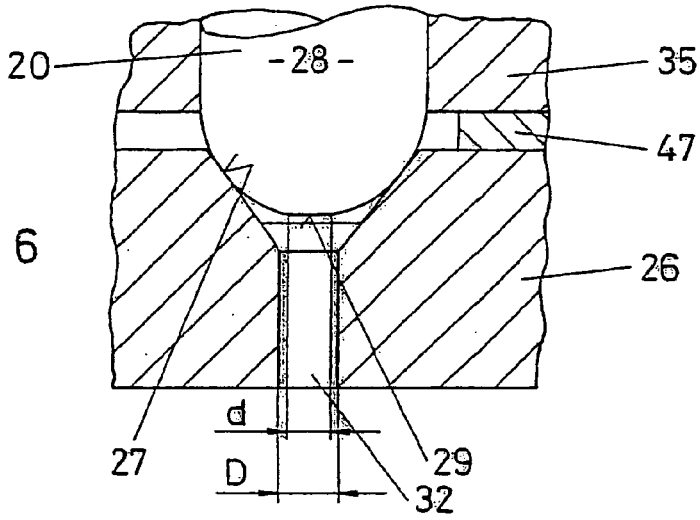
FIG. 6 shows a part of a valve needle end having a different geometry in comparison with the preceding embodiment.

FIG. 6 illustrates a valve needle end, shown partially here, having a different geometry in comparison with the previous embodiments. In the example illustrated in FIG. 6, d<D, i.e., flattened face 29 provided on the downstream end of valve needle 20 has a diameter d smaller than diameter D of outlet orifice 32 which follows on the downstream end. A defined breakaway of flow, which may be desirable for certain applications, can also be achieved with such a design.

Figure 7:
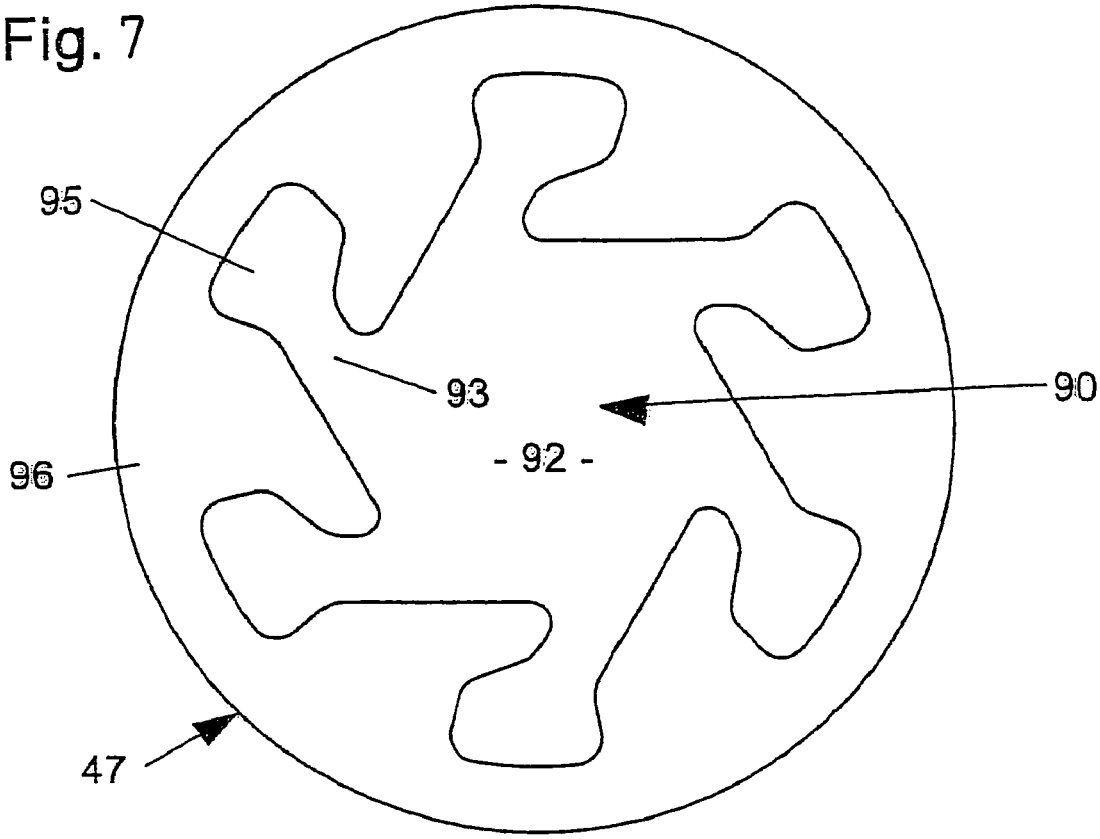
FIG. 7 shows a swirl element.

FIG. 7 shows a top view of a swirl element 47 embedded between guide element 35 and valve seat element 26 as a single part. Swirl element 47 can be produced inexpensively from sheet metal by punching, wire erosion, laser cutting, etching or other known methods or by galvanic deposition. An internal opening area 90 running over the entire axial thickness of swirl element 47 is provided in swirl element 47. Opening area 90 is formed by an inner swirl chamber 92 through which valve closing section 28 of valve needle 20 extends and by a plurality of swirl channels 93 opening into swirl chamber 92. Swirl channels 93 open tangentially into swirl chamber 92, and their ends 95 facing away from swirl chamber 92 are not connected to the outer circumference of swirl element 47. Instead, a peripheral edge area 96 remains between ends 95 of swirl channels 93, which are designed as inlet pockets, and the outer periphery of swirl element 47.

With valve needle 20 installed, swirl chamber 92 is delimited on the inside by valve needle 20 (valve closing section 28) and on the outside by the wall of opening area 90 of swirl element 47. Due to the tangential opening of swirl channels 93 into swirl chamber 92, a rotational momentum is imparted to the fuel and is maintained in the remaining flow as far as outlet orifice 32. Due to centrifugal force, fuel is sprayed in the form of a hollow cone. Ends 95 of swirl channels 93 function as collecting pockets whose large surface forms a reservoir for the fuel entering with little turbulence. After deflecting the flow, the fuel slowly enters actual tangential swirl channels 93 with low turbulence, so a swirl that is largely free of interference can be achieved.

Figure 8:
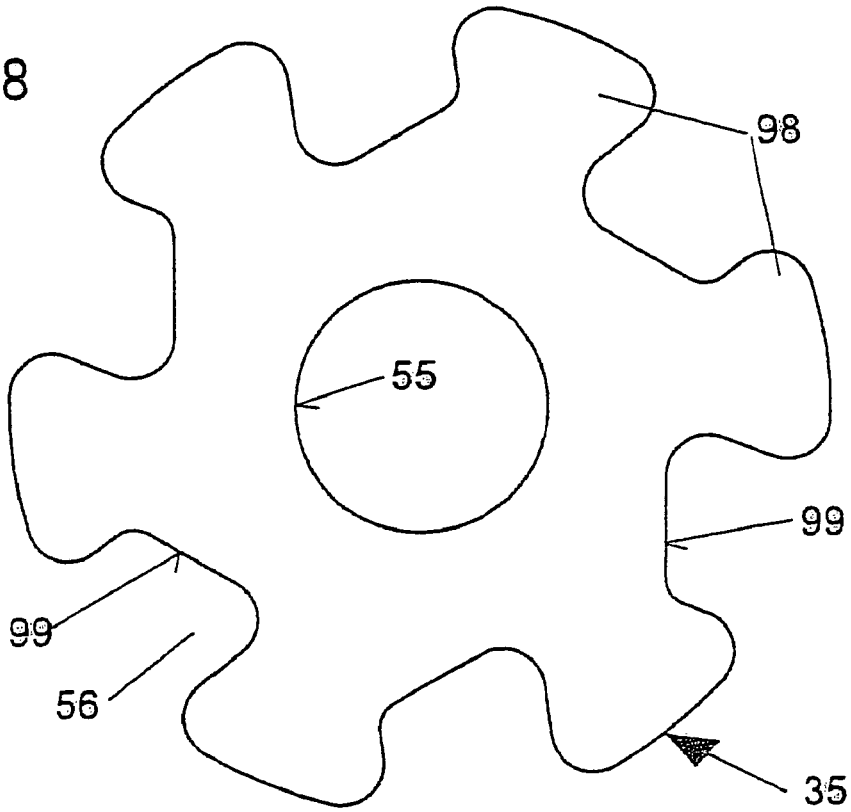
FIG. 8 shows a guide element which can be used in fuel injectors according to FIGS. 1 through 5.

FIG. 8 shows an embodiment of a guide element 35. Over its outer circumference, guide element 35 has recesses 56 and tooth-shaped projecting areas 98 in alternation. Tooth-shaped areas 98 may be rounded. Guide element 35 is manufactured by punching, for example. In the example according to FIG. 8, bases 99 of the recesses are designed at an inclination, so that bases 99 of the recesses run perpendicular to the axes of swirl channels 93 of swirl element 47 beneath them in an advantageous manner.

What is claimed is:

1. A fuel injector for a fuel injection system of an internal combustion engine, comprising:

an energizable actuating element;

a valve needle that is axially movable along a longitudinal axis of a valve;

a fixed valve seat;

a valve seat element including an orifice following downstream from the fixed valve seat;

a valve closing section arranged on a downstream end of the valve needle and for working together with the fixed valve seat for opening and closing the valve, wherein:

the fixed valve seat is designed on the valve seat element;

a flattened face running perpendicular to the longitudinal axis of the valve and being arranged on the downstream end of the valve closing section downstream from the fixed valve seat;

a guide element including alternating recesses and tooth-shaped projecting areas along a periphery of the guide element, the recesses configured to channel fuel through the guide element; and a swirl-producing element arranged upstream from the fixed valve seat and downstream of the guide element, wherein:

the flattened face includes a diameter d that is greater than a diameter D of an outlet orifice, and an entry plane of the outlet orifice is arranged such that the entry plane is completely covered by a projection of the flattened face into the entry plane in a direction perpendicular to the flattened face.

2. The fuel injector according to claim 1, wherein:

the fuel injector is configured for a direct injection of a fuel into a combustion chamber of the internal combustion engine.

3. The fuel injector according to claim 1, wherein:

a ratio of the diameter d of the flattened face to the diameter D of the outlet orifice is approximately 1.5.

4. The fuel injector according to claim 1, wherein:

the valve closing section includes a curved area that is at least partially one of spherical and rounded, and the flattened face is adjacent to the curved area.

5. The fuel injector according to claim 1, wherein:

the valve closing section includes a conical area that is at least partially a truncated conical taper in a downstream direction, and the flattened face follows the conical area.

6. The fuel injector according to claim 1, wherein:

the swirl-producing element includes a disk-shaped swirl element directly upstream from the fixed valve seat.

7. The fuel injector according to claim 1, wherein:

the outlet orifice is formed in the valve seat element.

8. The fuel injector according to claim 1, wherein the valve seat element includes a spray element which includes the outlet orifice and is arranged downstream from the valve seat face.

9. The fuel injector according to claim 6, wherein:

the disk-shaped element includes an inner opening area having a plurality of swirl channels that extend completely over an entire axial thickness of the disk-shaped swirl element, and the plurality of swirl channels is not connected to an outer periphery of the disk-shaped swirl element by a peripheral edge area.

10. The fuel injector according to claim 9, wherein:

the inner opening area is formed by an inner swirl chamber and by the plurality of swirl channels opening into the inner swirl chamber.

11. The fuel injector according to claim 10, wherein:

the plurality of swirl channels includes ends at a distance from the inner swirl chamber, and the ends as inlet pockets include a larger cross section than a remainder of the plurality of swirl channels.

12. A fuel injector for a fuel injection system of an internal combustion engine, comprising:

an energizable actuating element;

a valve needle axially movable along a longitudinal axis of a valve;

a fixed valve seat;

a valve seat element including an orifice following downstream from the fixed valve seat;

a valve closing section arranged on a downstream end of the valve needle and arranged to work together with the fixed valve seat to open and close the valve; wherein the fixed valve seat is arranged on the valve seat element;

wherein a flattened face extends perpendicular to the longitudinal axis of the valve and is arranged on the downstream end of the valve closing section downstream from the fixed valve seat;

wherein a guide element include alternating recesses and tooth-shaped projecting areas along a periphery of the guide element, the recesses configured to channel fuel through the guide element;

wherein a swirl-producing element is arranged upstream from the fixed valve seat and downstream of the guide element;

wherein the flattened face includes a diameter that is greater than a diameter of an outlet orifice; and wherein a projection of the flattened face in a direction perpendicular to the flattened face into an entry plane of the outlet orifice completely covers the entry plane.

* * * * *